United States Patent [19]

Motiwala

[11] Patent Number: 4,877,138

[45] Date of Patent: Oct. 31, 1989

[54] FASTENER HEAD ELEVATION MEASURING APPARATUS

[75] Inventor: Mohammad I. Motiwala, Everett, Wash.

[73] Assignee: The Boeing Company, Seattle, Wash.

[21] Appl. No.: 78,257

[22] Filed: Jul. 27, 1987

[51] Int. Cl.[4] ..... B07C 5/04

[52] U.S. Cl. ..... 209/601; 10/162 A; 209/626; 209/655; 209/929; 414/224

[58] Field of Search ..... 209/552, 600, 601, 604, 209/625, 626, 598, 655, 911, 929, 648, 658; 414/224; 10/162 A, 162.0; 33/178 R, 178 E, 542, 531; 200/61.42; 901/16, 13

[56] References Cited

U.S. PATENT DOCUMENTS

| | | | |
|---|---|---|---|
| 1,959,867 | 5/1934 | Lafferty et al. | 209/548 |
| 2,111,252 | 3/1938 | Sommers | 209/903 |
| 2,156,822 | 5/1939 | Smith | 209/929 |
| 2,291,572 | 7/1942 | Davis | 209/601 |
| 2,354,419 | 7/1944 | Lingerfelt et al. | 209/929 |
| 2,390,012 | 11/1945 | Timm et al. | 209/602 |
| 2,427,410 | 9/1947 | Krasa | 209/929 |
| 2,493,147 | 1/1950 | Kasper | 209/929 |
| 2,566,756 | 9/1951 | Wiseman | 209/929 |
| 2,768,743 | 10/1956 | White | 209/601 |
| 2,781,126 | 2/1957 | Wood | 209/600 |
| 2,790,548 | 4/1957 | Scherer | 209/626 |
| 2,880,868 | 4/1959 | Abbott | 209/929 |
| 3,168,196 | 2/1965 | Harder | 209/605 |
| 3,417,476 | 12/1968 | Martens | 209/604 |
| 3,650,397 | 3/1972 | Bornemeier | 209/929 |
| 3,709,328 | 1/1973 | Mohr et al. | 209/929 |
| 3,739,908 | 6/1973 | Gunther | 209/929 |
| 3,743,093 | 7/1973 | Klancnik | 209/929 |
| 3,855,708 | 12/1974 | Tann et al. | 33/174 |
| 4,008,805 | 2/1977 | Goerke et al. | 209/929 |
| 4,090,610 | 5/1978 | Luginbahl | 209/604 |
| 4,341,311 | 7/1982 | Gold et al. | 209/929 |

FOREIGN PATENT DOCUMENTS

| | | | |
|---|---|---|---|
| 0033501 | 4/1981 | Japan | 209/604 |

*Primary Examiner*—Robert B. Reeves
*Assistant Examiner*—Donald T. Hajec
*Attorney, Agent, or Firm*—Christensen, O'Connor, Johnson & Kindness

[57] ABSTRACT

An apparatus for measuring the elevation of the head of a flush head countersunk fastener (e.g., a bolt or a rivet) before installation, is disclosed. Fasteners (21) to be measured are dropped, one at a time, into a precisely sized hole (69*a* or 69*b*) in a split gauge block (63) such that the heads of the fasteners protrude above the upper surface of the gauge block. The magnitude of head protrusion or elevation above the upper surface of the gauge block is measured by a head elevation measuring instrument (43). If the measured value lies within an acceptable range, a signal suitable for use in controlling the countersink depth of the hole that is to receive the fastener is produced and the fastener is forwarded to a fastener insertion machine. If the measured value lies outside of the acceptable range, the fastener is rejected. Fasteners (21) leave the measuring apparatus by vertically aligning the hole (69*a* or 69*b*) in the split gauge block (63) with either a fastener insertion machine delivery tube (203*b*) or a rejection tube (203*a*), depending upon whether the fastener head elevation lies inside or outside the acceptable range. After the split guage block hole (69*a* or 69*b*) is aligned with the appropriate tube, the gauge block is split, resulting in the fastener dropping into the aligned tube and being transported to either the fastener insertion machine or a rejection bin.

15 Claims, 8 Drawing Sheets

FASTENER HEAD ELEVATION MEASURING APPARATUS

TECHNICAL AREA

This invention pertains to measuring apparatus and, more particularly, apparatus for precisely measuring the elevation of the head of a headed fastener.

BACKGROUND OF THE INVENTION

Headed fasteners are used in a multitude of industrial assembly processes. In the aircraft industry, large quatities of flat head and dome head (hereinafter generically referred to as flush head) countersunk fasteners in the form of rivets and bolts are used in fabricating wings and other parts of an aircraft. Such fasteners are inserted into predrilled countersunk holes in the pieces being fabricated. Rivets are tightened by forming a head on the end of the rivet remote from the countersunk headed end and bolts are tightened by installing a collar or a nut on the end of the bolt remote from the countersunk headed end. If the countersunk head of the headed fastener does not precisely fit into the countersink region of the predrilled hole (i.e., the funnel-shaped enlargement formed at the insertion surface of the workpiece), rather than the edge of the countersunk head being flush with the insertion surface after installation, either a part of the head of the fastener will protrude from the insertion surface or the head will be recessed in the surface. Both protruding and recessed installed fastener heads are undesirable in aircraft parts, particularly when the fastener insertion surface is to form an external aircraft surface, because sharp protrusions and recesses both create aerodynamic drag. While protruding fasteners can be machined to remove excessive protruding material, this is a time consuming and, thus, expensive procedure. Recess fastener heads are even more undesirable because they cannot be economically eliminated. Unfortunately, the tolerances of most currently available standard size countersunk headed fasteners are such that it is rare that a fastener will precisely fit a predrilled hole. In most instances, the head of such fasteners either protrudes from, or is recessed into, the insertion surface of the part being fabricated. While fastener tolerances can be tightened in order to reduce the number of installed fasteners having protruding or recessed heads, tightening tolerances significantly increase the cost of fasteners and, consequently, the cost of the part being fabricated. Hence, this is an undesirable resolution of this problem.

Fortunately, while precise fasteners cannot be economically manufactured, machine tools that can drill precisely sized holes in a part are available. The invention is designed to allow this feature of modern manufacturing equipment to be used advantageously. More specifically, the holes in which flat headed countersunk fasteners are to be installed have a cylindrical region for receiving the shank of the fastener and a countersink region for receiving the countersunk head of the fastener. After a cylindrical region sized to accept the shank of a fastener is drilled, a constant depth countersink is created on one end of the cylindrical hole. The depth of the countersink is set so that the "average" size fastener is flush with the insertion surface after a fastener is installed. As discussed above, frequently, the tolerances of fasteners result in the heads of some fasteners protruding from the insertion surface and the heads of other fasteners being recessed into the insertion surface. One way of avoiding this problem is to vary the depth of the countersink region of the fastener hole to compensate for tolerance variations. In order to accomplish this result, it is necessary to know the elevation of the head of the fastener to be installed in a particular hole. More specifically, it is necessary to know the elevation of the head above the point where the shank (e.g., the fixed diameter section) will intersect the cylindrical region of the hole in which the fastener will be installed. The invention is directed to providing an apparatus that measures this elevation.

SUMMARY OF THE INVENTION

In accordance with this invention, an apparatus for measuring the elevation of a flush head fastener (such as a flat or domed head countersunk rivet or bolt) prior to installation is provided. The apparatus comprises: a delivery mechanism for dropping fasteners one at a time into a precisely sized hole in a gauge block; a head elevation measuring instrument for measuring the magnitude of head protrusion above the upper surface of the gauge block; and, a discharge mechanism for delivering in measured fasteners to a fastener installation machine.

In accordance with other aspects of this invention, the gauge block is a split gauge block and the discharge mechanism comprises: a mechanism for splitting the gauge block after the elevation of the head of a headed fastener has been measured to allow the fastener to drop through the gauge block; and a tube assembly for delivering acceptable fasteners to a fastener installation machine (or an acceptance bin) and unacceptable fasteners to a rejection bin.

In accordance with further aspects of this invention, the delivery mechanism comprises: a delivery tube for dropping fasteners one at a time into a selected one of a multitude of precisely sized holes in the split gauge block; and, an alignment mechanism for aligning the gauge block and the delivery tube such that the selected hole is aligned with the delivery tube.

In accordance with yet other aspects of this invention, the split gauge block includes two precisely sized holes for receiving fasteners, each having a different diameter; and, the alignment mechanism includes a slide for supporting the exit end of the delivery tube and a first linear actuator for selectively aligning the exit end with the two precisely sized holes.

In accordance with still other aspects of this invention, the head elevation measuring instrument includes a vertically oriented linear sensor mounted on the slide adjacent to the exit end of the delivery tube; the split gauge block is slidably mounted for movement in a direction orthogonal to the direction of movement of the slide; and, the alignment mechanism includes a second linear actuator for selectively aligning the precisely formed holes in the split gauge block with either the exit end of the delivery tube or the linear sensor of the head elevation measuring instrument.

In accordance with further aspects of this invention, the second linear actuator of the alignment mechanism also selectively aligns the split gauge block in an intermediate position at which the head elevation measuring instrument is calibrated.

In accordance with yet still other aspects of this invention, the tube assembly of the discharge mechanism includes: a Y manifold positioned beneath the split gauge block such that one arm of the Y is aligned with each of the two precisely sized holes in the split gauge block when the split gauge block is split to drop a fastener; a two-hole slide block positioned beneath the leg of the Y; a two position linear actuator for selectively aligning either of the holes with the leg of the Y; and, fastener accept and fastener reject tubes attached to the holes.

As will be readily appreciated from the foregoing summary, this invention is directed to an apparatus for precisely measuring the elevation of the head of a fastener above a precisely sized hole in which the shank of the fastener resides. The invention is ideally suited for use in an automated assembly system having the capability of using head height information to control the depth of a countersink and, thus, make certain that the heads of installed fasteners are flush after installation. More specifically, by precisely sizing the hole(s) in the gauge block, the point where the countersunk region of the head impinges on the edge of the hole and, thus, the amount of protrusion or elevation of the head above the hole, can be precisely determined. This information is readily utilized to control the depth of the countersunk region of the specific hole that is to receive the fastener being measured so that the flat head of the fastener will be flush with the fastener insertion surface after the fastener has been installed. Alternatively, this information can be used to check the quality of fasteners prior to assembly in fixed size holes.

BRIEF DESCRIPTION OF THE DRAWINGS

The foregoing and other features and advantages of the present invention will become more readily appreciated as the same becomes better understood by reference to the following detailed description of a preferred embodiment of the invention when taken in conjunction with the accompanying drawings wherein.

DESCRIPTION OF THE PREFERRED EMBODIMENT

Figure 1:
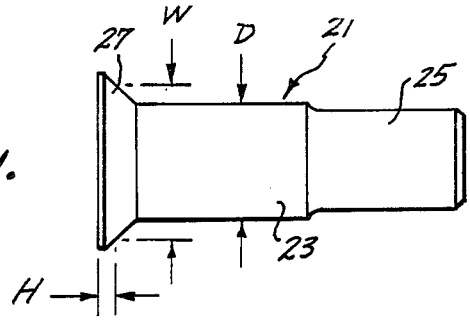
FIG. 1 is a plan view of a typical flush head countersunk fastener of the type utilized in the aircraft industry.

In order for the benefits of the invention to be better understood, prior to describing the preferred embodiment of the invention, a brief description of the problem associated with the way flush head fasteners are presently installed that is addressed by this invention is first described. In this regard, FIG. 1 is a plan view of a typical flush head fastener 21 utilized in the aircraft industry, specifically a flush head countersunk bolt. The flush head countersunk bolt illustrated in FIG. 1 includes three distinct integral regions: a shank 23; a tail 25; and a countersunk head 27. The countersunk head 27 and the tail 25 are located on opposite ends of the shank 23. The shank 23 and the tail 25 are cylindrical with the diameter of the tail 25 being slightly less than the diameter of the shank 23. The countersunk head has a frustoconical shape. While illustrated as flat headed, the countersunk head could be dome shaped.

Figure 2:
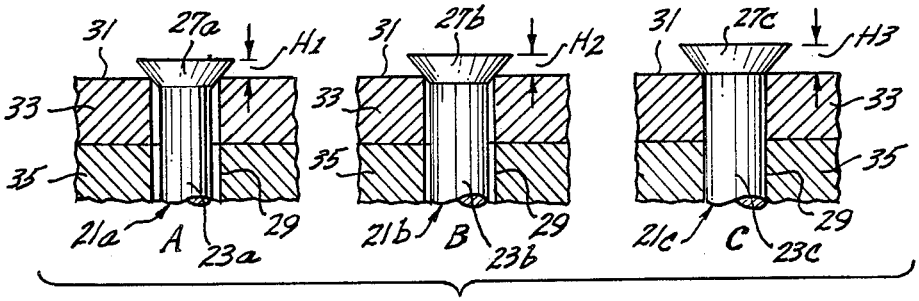
FIG. 2 is a series of diagrams illustrating different magnitudes of fastener head protrusion above the insertion surface of parts being fabricated prior to countersinking the fastener receiving holes.

In order to accommodate a fastener of the type illustrated in FIG. 1, the diameter, W, of the hole into which the fastener is to be inserted is made slightly larger (or smaller if an interference fit is desired) than the largest tolerance diameter, D, of the shank 23. Due to tolerances, the circumferential line where the edge of the hole contacts the countersunk head 27 will vary from fastener to fastener. As a result, the height, H, above the circumferential contact line will vary from fastener to fastener. This variation is depicted in FIG. 2. More specifically, FIG. 2 is a series of three views, labeled A, B and C, depicting different elevations of the head of a fastener of the type illustrated in FIG. 1 due to tolerance variations between the smallest size (view A) and the largest size (view C). The median tolerance size is illustrated in view B.

The holes 29 in which each of the FIG. 2 fasteners lie have the same diameter and are not countersunk. Consequently, the head 27 of each fastener 21 protrudes beyond the insertion surface 31 of the parts 33 and 35 being joined together. Because the smallest tolerance fastener 21*a* fits deeper into the hole 29, the elevation, H1, of the portion of the head 27*a* that protrudes above the insertion surface 31, is relatively small. Contrariwise, the largest tolerance fastener 21*c* does not fit deeply into the hole. As a result, the elevation, H3, of the portion of the head 27c that protrudes above the insertion surface 31, is relatively large. Because the median tolerance fastener 21b fits partway into the hole 29, the elevation, H2, of the head 27b that protrudes above the insertion surface 31 lies between H1 and H3.

Figure 3:
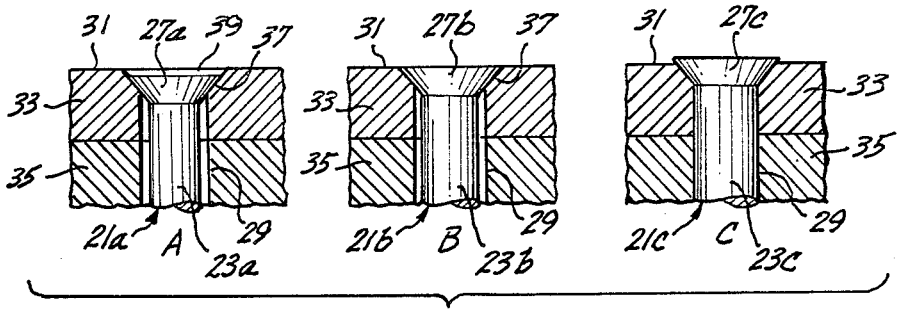
FIG. 3 is a series of diagrams illustrating fastener head position when the fastener receiving holes of FIG. 2 are countersunk to the same depth.
Figure 4:
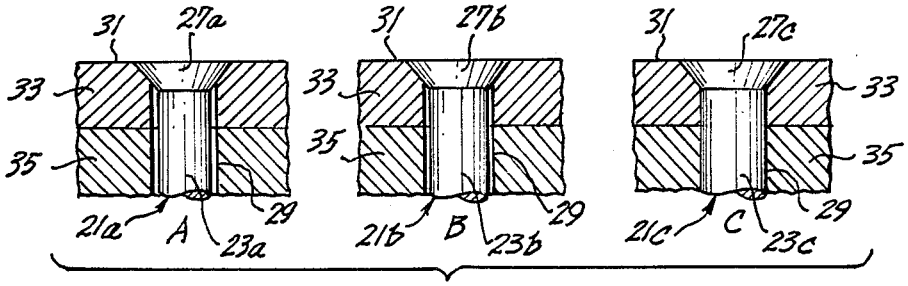
FIG. 4 is a series of diagrams illustrating fastener head position when the fastener receiving holes of FIG. 2 are countersunk to depths related to head height protrusion.

FIG. 3 is a series of three views, labeled A, B and C, and corresponding to views A, B and C of FIG. 2, depicting the position of rivets in holes 29 having a common depth countersunk region 37 extending inwardly from the insertion surface 31 of the parts 33 and 35 being joined. Because the head of the smallest tolerance fastener 21a drops deeper into the hole, a depression 39 is created at the insertion surface. Contrariwise, the head of the median tolerance fastener 21b lies flush with the insertion surface 31; and, the head 27 of the largest tolerance fastener 21c protrudes above the insertion surface 31. The invention is directed to generating information that can be used to solve this problem. More specifically, the invention is directed to measuring the elevation of the head of a flush head fastener prior to insertion and sending the measurement information to an automatic insertion machine that can use the information to control the depth of the countersink 37 so that a fastener, regardless of tolerance, will have a flush head when installed, i.e., the head of the fastener will be flush with the insertion surface 31 of the parts being joined. This result is illustrated in views A, B and C of FIG. 4, which correspond to similarly labeled views in FIGS. 2 and 3. Alternatively, the invention can be used to sort or classify fasteners in accordance with head elevation.

FIGS. 5–14 illustrate a fastener head elevation measuring apparatus formed in accordance with the invention that measures the elevation of the head of a fastener above a reference surface having a precisely machined hole in which the shank of the fastener lies. Each fastener is measured prior to installation. The elevation measurement information, which is in the form of an electrical signal, is suitable for transmission to a fastener installing apparatus having the capability of using the information to control the countersink depth for each individual fastener hole as it is being drilled. Alternatively, the head elevation measurement information can be used to control a sorting machine. In essence, the fastener head elevation apparatus illustrated in FIG. 1 measures head elevation in the way head elevation is depicted in FIG. 2 and described above.

Figure 5:
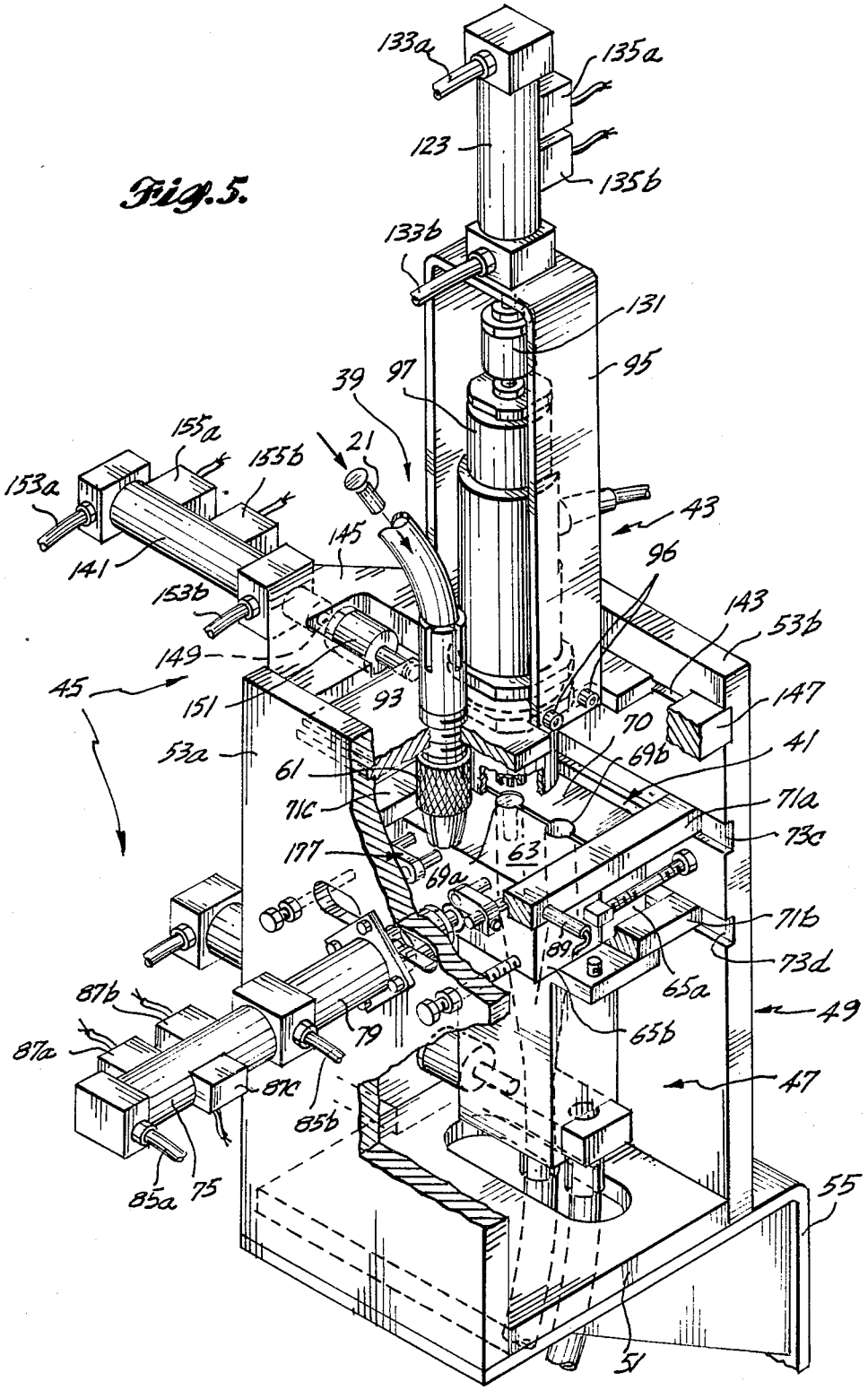
FIG. 5 is an isometric view, partially in section, of a fastener head elevation measuring apparatus formed in accordance with the invention.
Figures 6, 7:
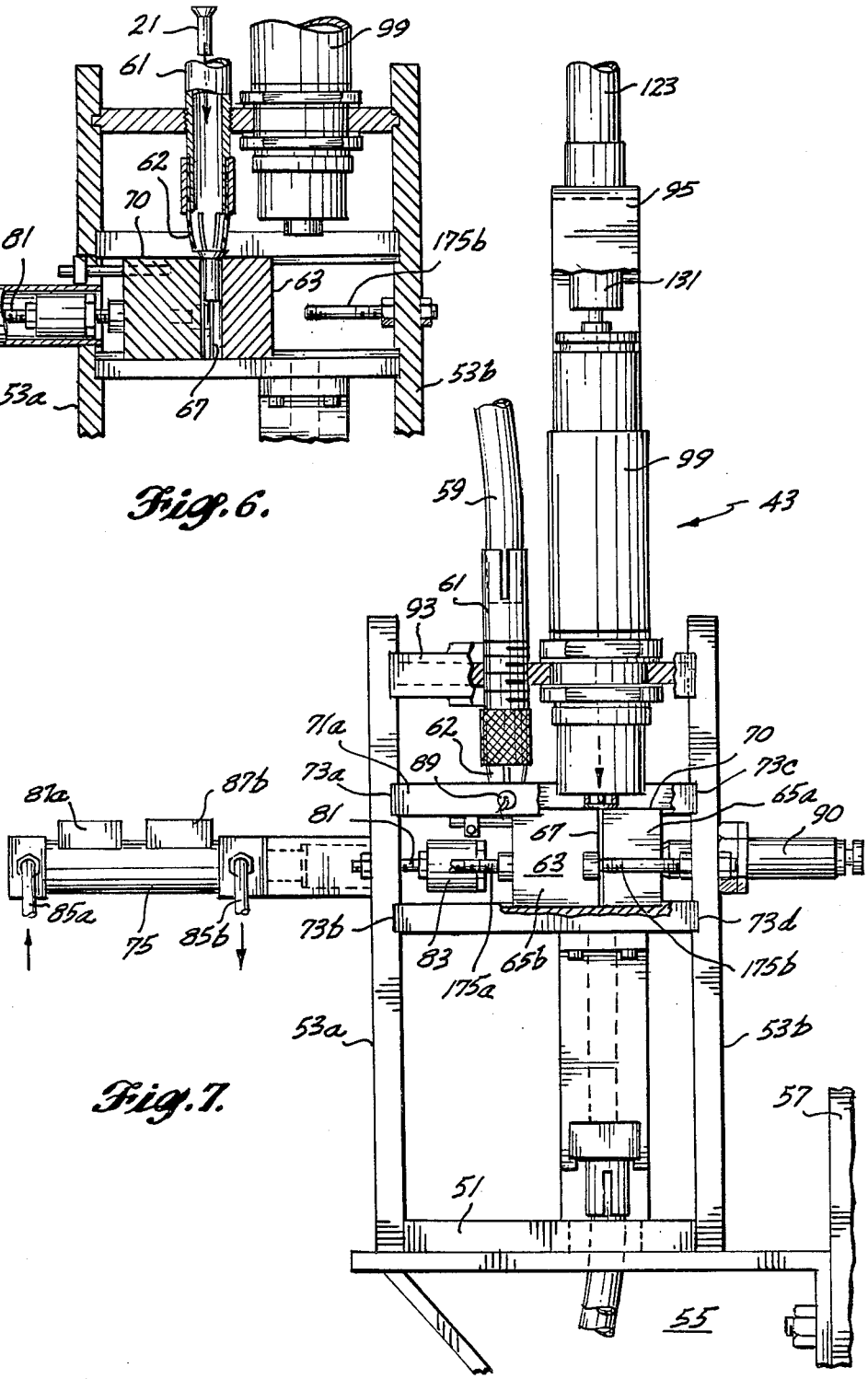
FIG. 6 is a partial cross-sectional view illustrating the alignment of the fastener delivery mechanism and the split gauge block of the fastener head elevation measuring apparatus of FIG. 1.
FIG. 7 is an elevational view, partially in section, of the fastener head elevation measuring apparatus illustrated in FIG. 1 showing the position of the split gauge block when the elevation of the head of a fastener is being measured.

The fastener head elevation measuring apparatus illustrated in FIG. 5 includes: a fastener delivery section 39; a split gauge block section 41; a head elevation measuring section 43; an alignment section 45; and, a fastener discharge section 47, all mounted in a frame 49. The frame 49 includes a rectangular base plate 51 and a pair of opposed sidewalls 53a and 53b all mounted atop a reinforced angle bracket 55. More specifically, the lower ends of the sidewalls 53a and 53b are attached to opposing edges of the base plate by bolts, welding or any other suitable attachment medium. The bracket 55 is right angled and has a vertical leg and a horizontal leg. The base plate 51 and the sidewalls 53a and 53b are mounted atop the horizontal leg. The vertical leg is designed to be attached to a suitable vertical surface such as a wall 57 (FIG. 7).

The fastener delivery section 39 includes a fastener delivery tube 59 and a nozzle 61 mounted on the outlet end of the delivery tube. The fastener delivery tube is flexible and the nozzle is rigid. The nozzle 61 is threadably mounted in a hole formed in a horizontal selector plate 93 that forms part of the alignment section 45. Thus, the nozzle 61 is vertically oriented. Fingers 62, preferably formed of DELRIN, are attached to the lower end of the nozzle to center fasteners in holes in the hereinafter described gauge block 41. DELRIN is an acetal resin manufactured by E. I. Du Pont de Nemours & Company.

The split gauge block section 41 is located beneath the selector plate 91 and includes a split gauge block 63 formed by a pair of blocks 65a and 65b. More specifically, each of the blocks 65a and 65b defines a right rectangular parallelepiped and the blocks face one another along a common vertical plane 67. The common vertical plane lies parallel to the sidewalls 53a and 53b. The split gauge block 63 includes a pair of precisely machined, vertically oriented holes 69a and 69b centered on the common vertical plane 67 that open into the upper surface 70 of the split gauge block. Each of these holes is precisely machined. Since the holes are centered on the common vertical plane 67, they form semicircular indentations in each of the blocks 65a and 65b.

Figure 14:
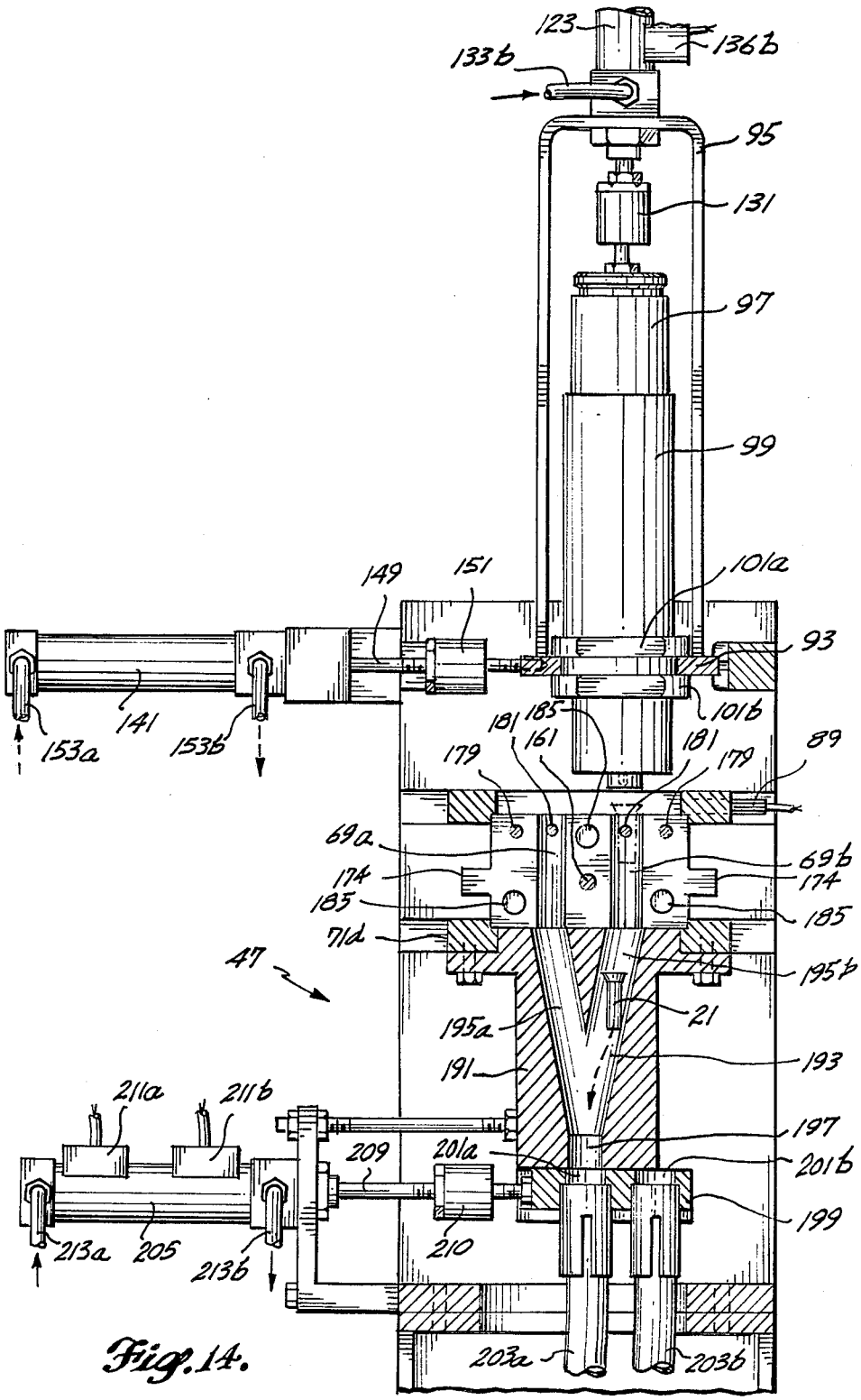
FIG. 14 is a cross-sectional view showing the position of the fastener discharge mechanism when the head elevation of a fastener falls outside acceptable limits; and, FIG. 15 is a block diagram of the sensor and actuator elements of the fastener head elevation measuring apparatus illustrated in FIG. 5 connected to a controller.

The split gauge block 63 is supported by four parallel guide rails 71a, 71b, 71c and 71d that, in turn, are supported by the sidewalls 53a and 53b. More specifically, pairs of aligned, spaced apart, horizontal slots 73a and 73b, and 73c and 73d are formed in each of the sidewalls 53a and 53b. See FIG. 7. The support rails are mounted in the aligned parallel slots crosswise between the sidewalls. That is, the ends of an upper pair of support rails 72a and 71c are mounted in the upper pair of aligned slots 73a and 73c and the ends of a lower pair of support rails 71b and 71d are mounted in the lower pair of support slots 73b and 73d. The guide rails are positioned such that each of the upper guide rails 71a and 71c is vertically aligned with one of the lower guide rails 71b and 71d. The innermost corners of the guide rails of the resulting cross-sectionally rectangular configuration are undercut, i.e., the guide rails have a generally L-shaped cross-sectional configuration as shown in FIG. 14. The corners of the split gauge block 63 lying orthogonal to the common vertical plane 67 are positioned in the undercut regions. Thus, the common vertical plane lies orthogonal to the longitudinal axes of the guide rails 71a–d and the upper surface of the split guide block, hereinafter referred to as the split gauge block reference surface 70, is horizontal.

The split gauge block is slid back and forth by a gauge block actuator 75 that forms part of the alignment section 45. The gauge block actuator 75 is a three-position linear pneumatic actuator. The housing of the gauge block actuator 75 is mounted on one end of a cylindrical bracket 79 that, in turn, is mounted on the outer face of one of the sidewalls 53a in alignment with the split gauge block 63. The gauge block actuator 75 is oriented such that the rod 81 of the gauge block actuator extends into the cylindrical bracket and faces the nearest block 65b of the split gauge block 61. The rod 81 of the gauge block actuator is coupled to the nearest block element 65b by an adjustable coupling mechanism 83. See FIG. 7. Attached to the ends of the gauge block actuator 75 are pressurized air lines 85a and 85b. In a conventional manner, when pressure is applied to one of the lines 85a, the rod 81 of the gauge block actuator 75 is extended and when pressure is applied to the other line 85b, the rod of the gauge block actuator is retracted. Located at opposite ends and in the center of the gauge block actuator are position sensors 87a, 87b and 87*c*. One of the end sensors 87*a* senses when the rod of the gauge block actuator is retracted and the other end sensor 87*b* senses when the rod of the gauge block actuator is extended. The center sensor 87*c* senses when the gauge block actuator is in its center position. As will be better understood from the following description of the operation of the invention, the sensor 87*a* that senses when the rod is retracted forms a gauge block fastener receive position sensor, the sensor 87*b* that senses when the rod is extended forms a gauge block fastener measure position sensor and the sensor 87*c* that senses when the rod is centered forms a linear encoder calibration position sensor. While the gauge block fastener receive and fastener measure position sensors 87*a* and 87*b* and the linear encoder calibration position sensor 87*c* can take on various forms, preferably, they are magnetic sensors that have the ability to sense when the piston of the gauge block actuator 75 is adjacent to the sensor, i.e., they are magnetic proximity sensors.

Mounted in one of the upper guide rails 71*a*, in alignment with region between the lower end of the nozzle 61 and the gauge block reference surface 70 is an optical sensor 89. Thus, the optical sensor is positioned to sense when a fastener 21 is dropped into one of the holes 69*a* or 69*b* of the split gauge block 63 and cleared the nozzle 62; and, when a fastener has only partially dropped into a hole and, thus, has not cleared the nozzle 62. Hence, the optical sensor forms a fastener received in gauge block sensor.

Mounted in the sidewall 53*b* remote from the sidewall on which the gauge block actuator is mounted is a shock absorber 90. The shock absorber 90 damps vibrations of the gauge block when the rod 81 of the gauge block actuator 75 is extended.

Figure 8:
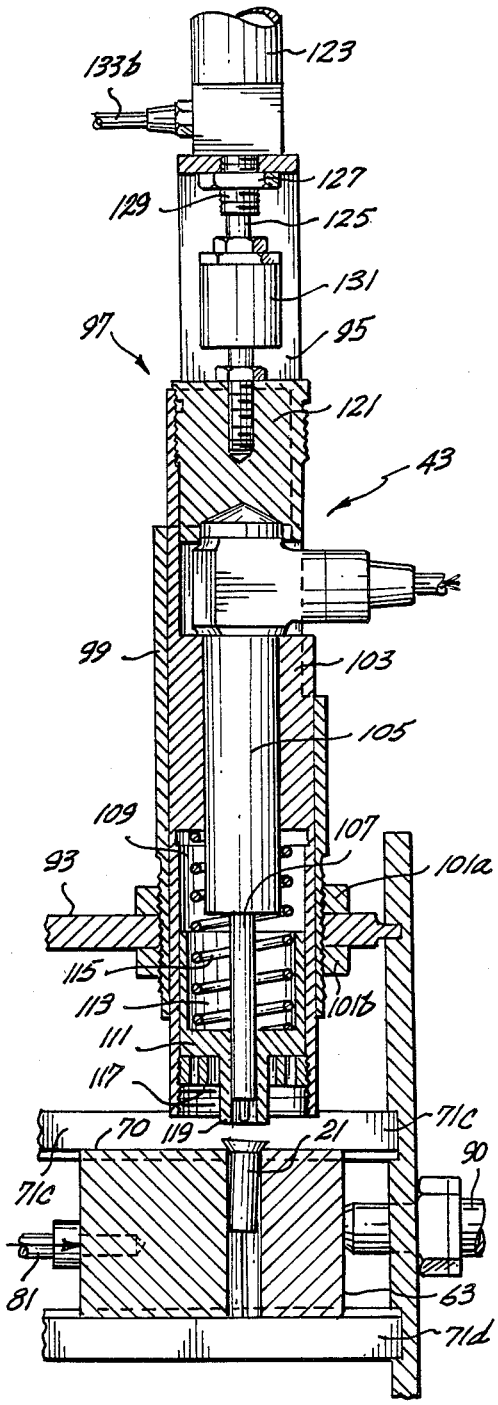
FIG. 8 is a vertical cross-sectional view showing the position of the elevation measuring instrument of the fastener head elevation measuring apparatus illustrated in FIG. 5 prior to measurement.
Figure 9:
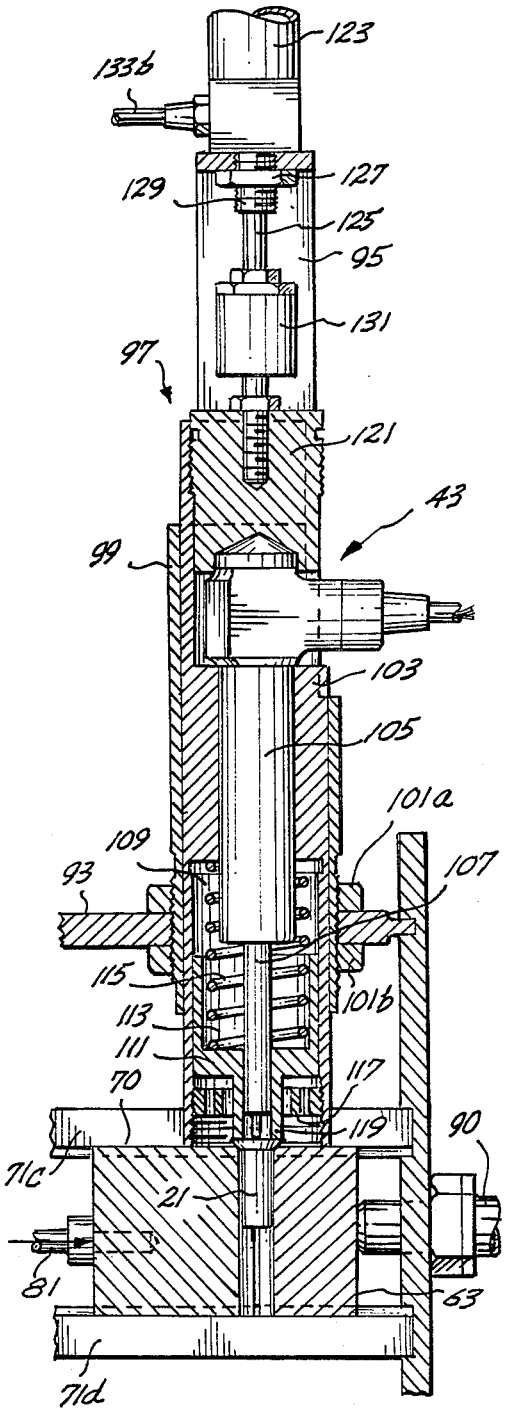
FIG. 9 is a vertical cross-sectional view showing the position of the elevation measuring instrument of the fastener head elevation measuring apparatus illustrated in FIG. 5 during measurement.

The head elevation measuring section 43 is mounted on the selector plate 93 adjacent to the nozzle 61 of the fastener delivery section 39. As best illustrated in FIGS. 5, 8 and 9, the head elevation measuring section includes an elongate, U-shaped bracket 95 mounted atop the selector plate 93. The U-shaped bracket 95 is inverted, i.e., the legs of the U-shaped bracket 95 extend downwardly. The ends of the legs of the U-shaped bracket 95 are attached to the selector plate 93 by cap screws 96, for example. The U-shaped bracket 95 and the nozzle 61 are positioned such that the center vertical plane 67 of the split gauge block 63 lies beneath the U-shaped bracket 95 when the rod 81 of the gauge block actuator 75 is extended and beneath the nozzle 61 when the rod is retracted.

As best shown in FIGS. 8 and 9, mounted inside of the U-shaped bracket 95 is a vertically oriented telescoping housing 97. The telescoping housing 97 includes an outer tubular member 99 that is threaded into a hole in the selector plate 93 and held in position by lock nuts 101*a* and 101*b* positioned on opposite sides of the selector plate 93. Slidably mounted in the outer tubular member 99 is an inner tubular member 103. The inner tubular member houses a linear encoder 105 such as a Model DG-25S, manufactured by Sony Corporation. The linear encoder 105 is oriented such that the encoder's linear sensing element 107 extends downwardly.

A large cylindrical cavity 109 is located in the lower end of the inner tubular member 103. Slidably mounted in the cavity 109 is a piston 111. Located at the upper end of the piston 111 is a cavity 113. A coil spring 115 extends between the bottom of the piston cavity 113 and the top of the large cylindrical cavity 109. Thus, the coil spring 115 applies a downward force to the piston 111. Downward movement of the piston 111 is limited by a collar 117 that is threaded into the lower end of the large cylindrical cavity 109 of the inner tubular member 103. The lower end of the piston 111 includes a cylindrical protrusion 119 that surrounds the sensing element 107 of the linear encoder 105. A cap 121 threaded into the upper end of the inner tubular member 103 presses the housing of the linear encoder 105 against the main body of the inner tubular member 103 to hold the linear encoder relatively rigidly in the inner tubular member 103.

Mounted atop the U-shaped bracket 95 is a measuring instrument actuator 123. The measuring instrument actuator 123 is a two position linear actuator that is oriented such that the rod 125 of the actuator is vertical and passes through a hole in the crossmember of the U-shaped bracket 95. The measuring instrument actuator 123 is held in place by a lock nut 127 mounted on a threaded collar 129 that surrounds the rod 125. Preferably, the measuring instrument actuator is a pneumatic actuator. A coupling mechanism 131 attaches the end of the rod 125 of the measuring instrument actuator 123 to the cap 121 located at the upper end of the inner tubular member 103. Since the inner tubular member 103 is slidably mounted in the outer tubular member 99, extension and retraction of the rod 125 of the measuring instrument actuator 123 causes the inner tubular member 103 to slide in the outer tubular member 99.

As shown in FIG. 5, attached to opposite ends of the measuring instrument actuator 123 are air pressure lines 133*a* and 133*b*. As also shown in FIG. 5, attached to the upper end of the housing of the measuring instrument actuator 123 is a measuring instrument retracted sensor 135*a*. Attached to the lower end of the housing of the measuring instrument actuator 123 is a measuring instrument extended sensor 135*b*. Like the sensors 87*a* and 87*b* mounted in the gauge block actuator 75, the sensors attached to the measuring instrument actuator 123 are proximity sensors that sense the proximity of the piston of the measuring instrument actuator 123.

In addition to the selector plate 93 and the gauge block pneumatic actuator 75, the alignment section 45 also includes a selector plate actuator 141 for positioning the selector plate. In this regard, the selector plate 93 is slidably mounted in a pair of aligned horizontal slots 143 formed in the inner surfaces of the sidewalls 53*a* and 53*b* of the housing 49. The slots 143 lie above the slots 73*a–d* in which the split gauge block rails 71*a–d* are mounted.

A yoke 145 is mounted between the inner surfaces of the sidewalls 53*a* and 53*b* at one end of the slots 143 in which the selector plate 93 is mounted. The yoke 145 is positioned such that: the outer surfaces of the legs of the yoke intersect the inner surfaces of the sidewalls 53*a* and 53*b*; the crossmember of the yoke 145 is horizontal, i.e., lies parallel to the selector plate 93; and, the aperture in the yoke 145 faces the selector plate 93. Mounted between the sidewalls 53*a* and 53*b*, at the other end of the slots 143, is a crossbar 147. The yoke 145 and crossbar 147 are adjustable with respect to one another in their common plane. The adjustment is used to stop the selector plate 93 and align the gauge block holes 69*a* and 69*b* at precise positions beneath the nozzle 61 and the linear encoder sensing element 107.

The selector plate actuator 141 is mounted on the outer face of the crossmember of the yoke 145. The selector plate actuator 141 is a two position linear actuator mounted such that its rod 149 passes through the crossmember of the yoke 141. Preferably, the selector plate actuator is a pneumatic actuator. The outer end of the selector plate actuator rod 149 is attached to the selector plate 93 by a coupler 151. As a result, when the rod is moved back and forth, the selector plate is slid back and forth between a position adjacent to the legs of the yoke 145 and a position adjacent to the crossbar 147. Attached to the opposite ends of the selector plate actuator are air pressure lines 153*a* and 153*b*. Attached to the opposite ends of the housing of the selector plate actuator are selector plate position 1 and selector plate position 2 sensors 155*a* and 155*b*. Like the sensors 87*a* and 87*b* mounted on the gauge block actuator 75 and the sensors 135*a* and 135*b* mounted on the measuring instrument actuator 123, the sensors 155*a* and 155*b* mounted on the selector plate actuator 141 are proximity sensors (preferably magnetic) that sense the proximity of the piston of the selector plate actuator 141.

The alignment section 45 aligns the appropriate precisely sized hole 69*a* or 69*b* with nozzle 61 when a fastener 21 is being delivered to the fastener head elevation apparatus and the hole that received the fastener with the linear encoder 105 when the elevation of the head of the fastener is being measured. More specifically, when a fastener 21 is being delivered, the gauge block actuator 75 is actuated by air pressure to retract its rod 81. As a result, the split gauge block is moved to a position whereat the common vertical plane 67 is aligned with the nozzle 61 of the fastener delivery section 39. At the same time, the selector plate actuator 141 is energized to extend or retract its rod 149 to align the nozzle 61 with the appropriate precisely sized hole 69*a* or 69*b* if the nozzle is not aligned with the appropriate hole. After the fastener 21 has dropped into the aligned hole 69*a* or 69*b*, the gauge block is energized to extend its rod 81. As a result, the fastener is moved to a position in alignment with the linear encoder 105. Then, the measuring instrument section is activated to measure the elevation of the head of the fastener above the split gauge block reference surface 70.

Figure 15:
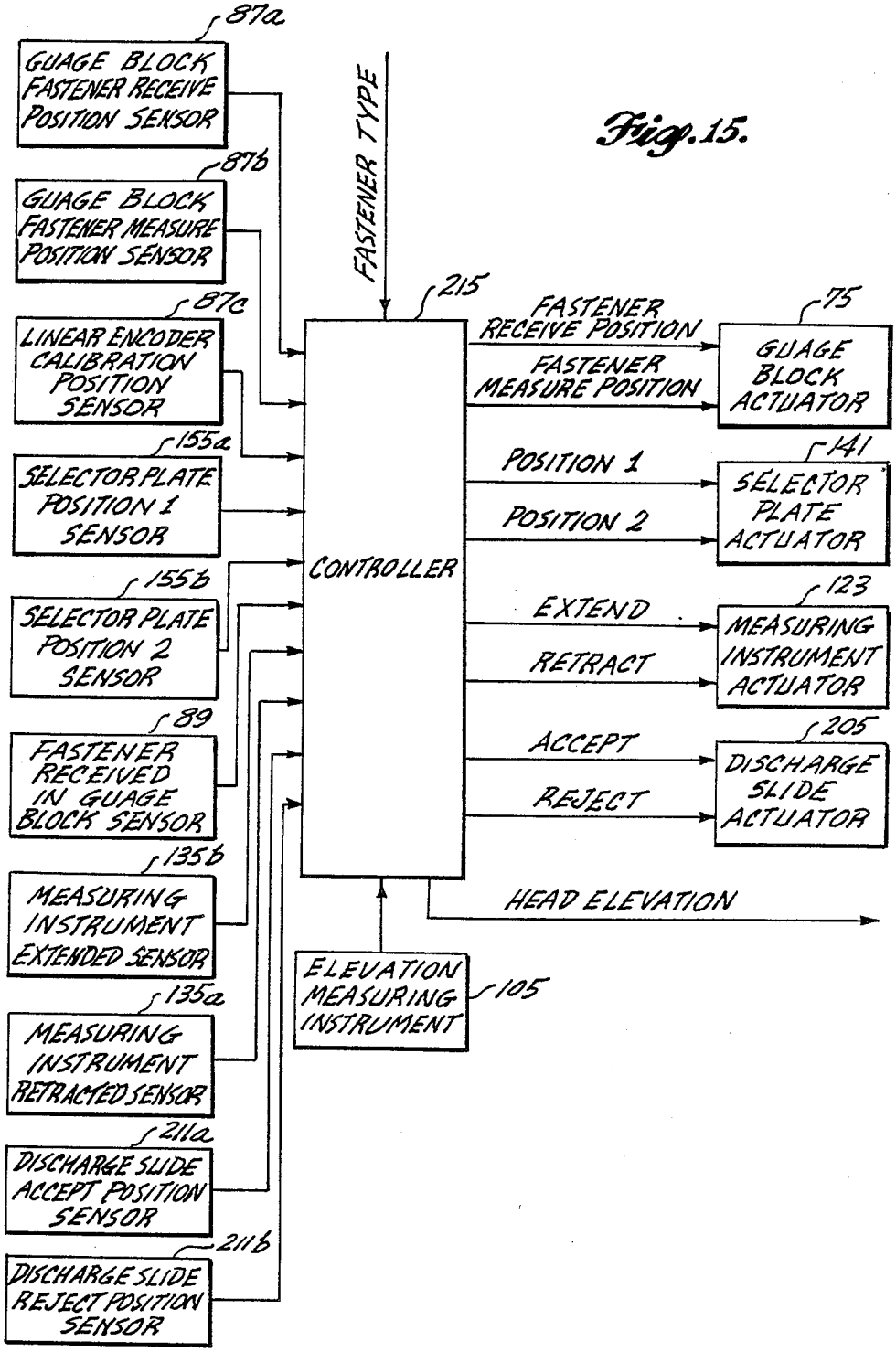

FIG. 8 illustrates the position of the measuring instrument section 43 when a fastener is being moved to a position beneath the linear encoder 105 and FIG. 9 illustrates the position of the measuring instrument section 43 when the head elevation of a fastener is being measured. During the time that a fastener is being moved to a position beneath the measuring instrument section 43, the linear encoder 105 is held in a retracted position by hydraulic pressure applied to the lower end of the measuring instrument 123. After the split gauge block 63 and the fastener it is holding have been moved to a position beneath the linear encoder 105, air pressure is applied to the upper end of the measuring instrument actuator 123. As a result, the rod 125 of the measuring instrument actuator 123 is extended. Extension of the rod 125 moves the inner cylinder member 103 of the measuring instrument section downwardly. The first part of the measuring instrument section 43 that impacts the head of the aligned fastener 21 is the cylindrical protrusion 119 that surrounds the sensing element 107 of the linear encoder 105. When the cylindrical protrusion 119 first contacts the head of the fastener 121, the fastener is pressed tightly into the hole in the split gauge block 63. Continued downward movement of the inner tubular member 103 first results in the piston 111 being raised slightly and the spring 115 being slightly compressed. When the tip of the sensing element 107 of the linear encoder 105 impacts the head of the fastener 21, continued downward movement results in the sensing element being raised into the linear encoder housing as the piston is raised and the coil spring further compressed. Downward movement ends when the lower end of the inner tubular member 103 impacts the split gauge block reference surface 70. Termination of downward movement is detected by the measuring instrument extended sensor 135*b* sensing the presence of the piston of the measuring instrument actuator 123. When the termination of downward movement is sensed, the output of the linear encoder 105 is read. The output is then sent to a controller, as illustrated in FIG. 15 and described below.

The linear encoder 105 is calibrated (i.e., indexed to zero) by energizing the gauge block actuator 75 until the linear encoder calibration sensor indicates that the gauge block is at an intermediate position whereat a flat part of the reference surface 70 of the gauge block 63 lies beneath the linear encoder. Thereafter, the linear encoder is operated in the manner just described to detect the elevation of the reference surface, which elevation is calibrated to zero. Thereafter, the measurement reading when a fastener head is located beneath the linear encoder is the elevation of the fastener head above the gauge block reference surface.

After the elevation of the head of a fastener is measured in the manner just described, the inner tubular member 103 is raised by applying air pressure to the lower end of the measuring instrument actuator 123. After the inner tubular member 103 is fully retracted, the fastener is removed from the split gauge block 63 by splitting the gauge block in the manner illustrated in FIGS. 10–12 and next described. As described below, when the split gauge block 63 is split, the fastener drops and is deliverd either to a fastener installation machine or a reject bin, depending upon whether the head elevation measurement is within, or outside of, an acceptable range.

Figure 10:
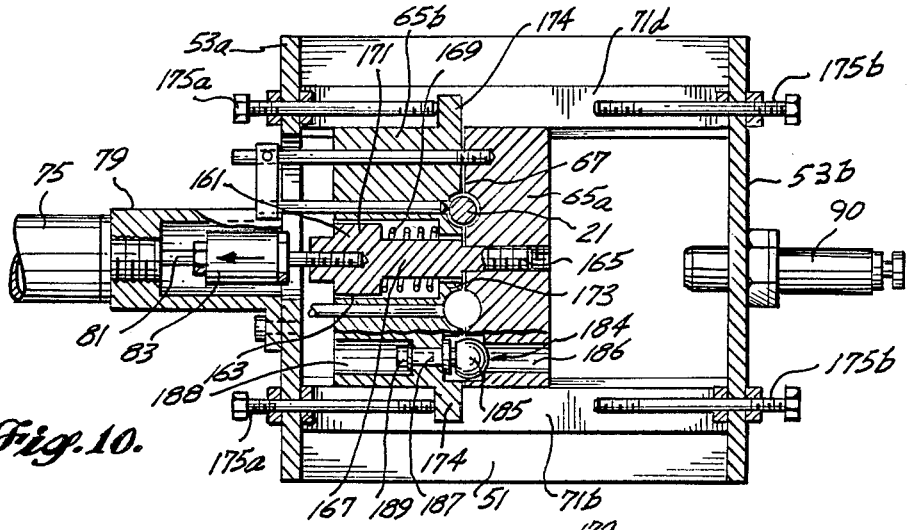
FIG. 10 is a horizontal cross-sectional view showing the split gauge block of the fastener head elevation measuring apparatus illustrated in FIG. 5 in the fastener receiving position.
Figure 11:
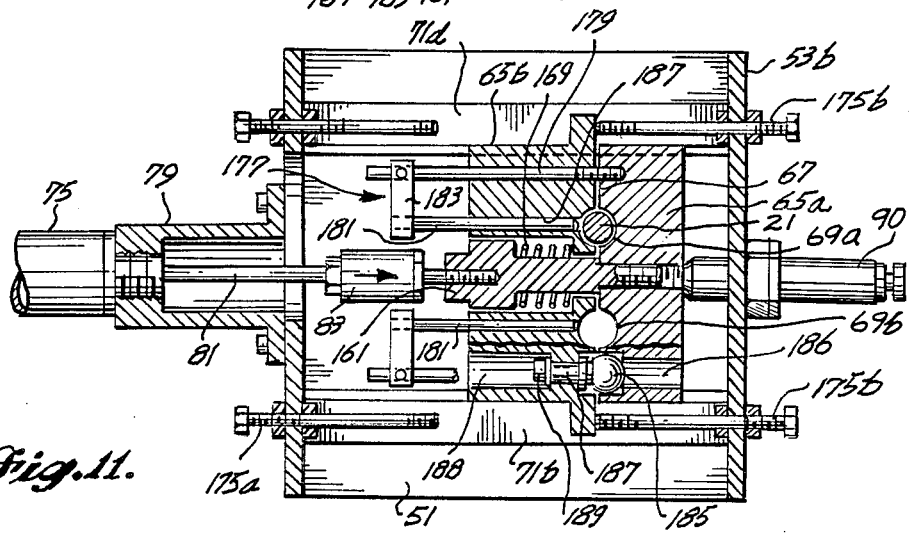
FIG. 11 is a horizontal cross-sectional view showing the split gauge block of the fastener head elevation measuring apparatus illustrated in FIG. 5 in the measuring position, prior to fastener ejection.
Figure 12:
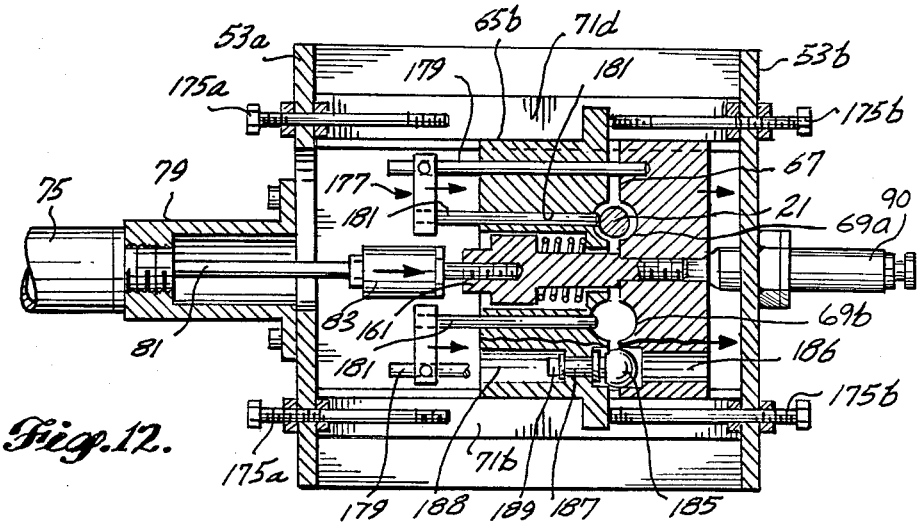
FIG. 12 is a horizontal cross-sectional view showing the position of the split gauge block of the fastener head elevation measuring apparatus illustrated in FIG. 5 during fastener ejection.

As illustrated in FIGS. 10–12, the blocks 65*a* and 65*b* that form the split gauge block 63 are held together by a spring loaded assembly that includes a cylindrical stud 161 that lies in cavity 163 formed in the block 65*b* nearest the gauge block actuator 63. The cavity 163 is aligned with the gauge block actuator rod 81; and, the coupler 83 connects the gauge block actuator rod 81 to one end of the stud 161. The other end of the stud 161 is threaded into a threaded hole 165 formed in the other block 65*a*. The stud 161 includes a small diameter section 167, located adjacent to the threaded end that is attached to the other block 65*a*, followed by a shoulder 171. A coil spring 169 surrounds the small diameter section 167 between the shoulder 171 of the stud 161 and an integral collar 173 located on the remote end of the cavity 163 in which the stud lies.

Located along the opposing vertical edges of the block 65*b* that is nearest to the gauge block actuator 75 are outwardly protruding shoulders 174. The shoulders are positioned adjacent to the common vertical plane 67 defined by the facing surfaces of the blocks 65*a* and 65*b*. The shoulders 174 impinge on pairs of stops 175*a* and 175*b* located at opposite ends of the path of travel of split gauge block 61. The stops 175*a* and 175*b* are formed by bolts threaded through the opposing sidewalls 53*a* and 53*b* of the housing 49.

The stops 175*a* threaded through the wall 53*a* of the housing on which the gauge block actuator 75 is mounted simply limit the near position of the split gauge block 61. Contrariwise, the stops 175*b* threaded through the other wall 53*b* function both as stops and as part of the fastener discharge section. More specifically, movement of the split gauge block to the position where a fastener is located beneath the linear encoder 105 of the elevation measuring instrument 43 stops when the shoulders 174 of the split gauge block impinge on the remote stops 175*b*. Motion of the remote block 65*a* stops because at this time the air pressure applied to the gauge block actuator 75 is insufficient to overcome the force of the coil spring 169 located between the blocks 65*a* and 65*b* and any force created by the shock absorber 90. This position of the split gauge block is illustrated in FIG. 11.

After the elevation of the fastener head is measured in the manner previously described, and the linear encoder 105 is raised, the pressure of the air applied to the gauge block actuator 75 is increased. The additional pressure compresses the coil spring 169 and counteracts any force created by the shock absorber, resulting in the block 65*a* remote from the gauge block actuator moving away from the nearer block 65*b*. As a result, the hole in which the fastener resides is enlarged and the fastener is dropped out of the lower end o the hole.

Removal of the fastener from the hole is assured by an ejection mechanism 177. The ejection mechanism comprises two parallel rods 179 and 181 and a bar 183 associated with each precisely sized hole 69*a* and 69*b*. One end of the first rod 179 is threaded into the block 65*a* remote from the gauge block actuator 75 and the body of the first rod 179 is slidably mounted in a hole formed in the nearer block 65*b*. The other end of the first rod extends beyond the outer surface of the nearer block 65*b* and is attached to one end of the bar 183. Attached to the other end of the bar 183 is the second rod 181. The second rod is slidably mounted in a second hole in the nearer block 65*b*. The second hole lies parallel to the hole for the first rod 179. Further, the second hole is aligned with one of the precisely sized holes 69*a* or 69*b* formed in the split gauge block 63. When the blocks 65*a* and 65*b* are juxtaposed, the inner end of the second rod is located slightly inwardly from the surface of the wall of the precisely sized hole 69*a* or 69*b* that the second rod is aligned with. As a result, as shown in FIG. 12, when the blocks 65*a* and 65*b* are spread apart, in the manner heretofore described, the inner end of the second rod 185 enters the related precisely sized hole 69*a* or 69*b* and moves the fastener away from the wall of the precisely sized hole 69*a* or 69*b*. This action maintains the fastener in the center of the hole, resulting in the fastener readily dropping when the hole becomes adequately enlarged.

After a period adequate for the fastener to leave the enlarged hole, the increased air pressure applied to the gauge block actuator 75 ends and the blocks 65*a* and 65*b* return to their juxtaposed position. Thereafter, the split gauge block 63 is returned to the fastener receiving position.

Figure 13:
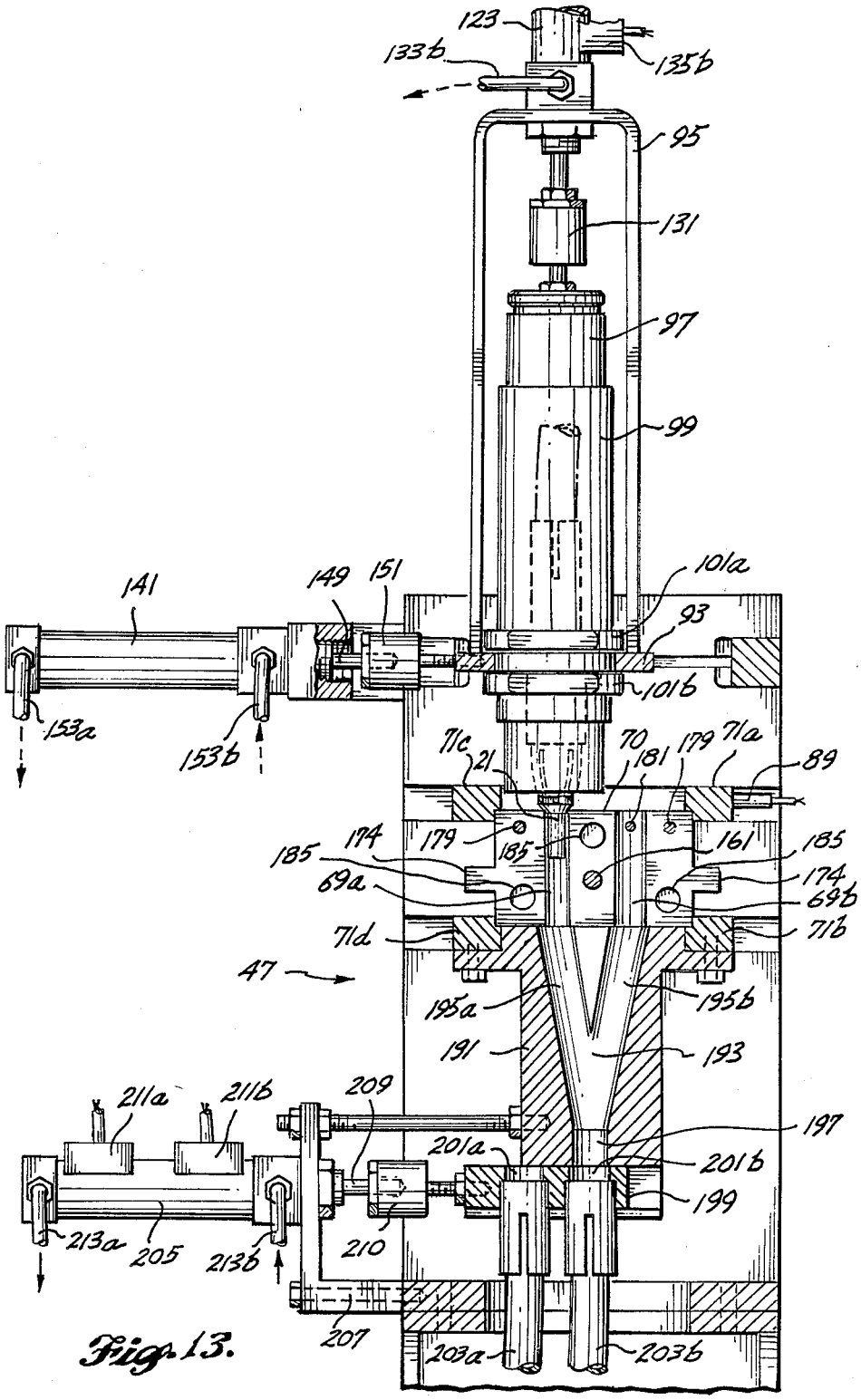
FIG. 13 is a cross-sectional view showing the position of the fastener discharge mechanism when the head elevation of a fastener falls within acceptable limits.

Twisting of the gauge block elements 65*a* and 65*b* with respect to one another during movement is avoided by three alignment mechanisms 184. As shown in FIGS. 10–12, each of the alignment mechanisms 184 includes a tooling ball 185 mounted on the block 65*b* adjacent to the gauge block actuator and positioned in holes 186 formed in the block 65*a* remote from the gauge block actuator 75. More specifically, the tooling balls 185 are located on the ends of integral pins 187 mounted in holes 188 formed in the adjacent block 65*b*. The pins are held in place by cap screws 189 and each ball 185 is aligned with a hole 186 in the block 65*a* remote from the gauge block actuator 75. When the blocks 65*a* and 65*b* are juxtaposed, the balls 185 are nested in their associated holes 186. The position of the three tooling balls 185 are illustrated in FIG. 13.

The discharge section 47 of the fastener head elevation measuring apparatus illustrated in the drawings directs fasteners with unacceptable head elevations to a discharge bin and fasteners with acceptable head elevations to a fastener installation machine. This portion of the discharge section is best illustrated in FIG. 13.

Attached to the lower pair of guide rails 71*b* and 71*d* that support the split gauge block 63 is a manifold 191. The manifold 191 has a Y-shaped conduit 193 and is positioned such that each of the arms of the conduit 195*a* and 195*b* is aligned with one of the precisely sized holes 69*a* and 69*b* when the split gauge block is positioned beneath the measuring instrument section 43. Mounted in the base of the manifold 191 is a slide 199. The slide 199 includes two vertical apertures 201*a* and 201*b* positioned to be alignable with the leg 197 of the Y-shaped conduit 193. Attached to the lower end of each of the vertical apertures 201*a* and 201*b* are a pair of tubes 203*a* and 203*b*. One of the tubes is a reject tube 203*a* runs to a fastener reject bin and the other is an accept tube 203*b* that runs to a fastener installation machine.

The position of the vertical apertures 201*a* and 201*b* in the slide 199 is controlled by a discharge slide actuator 205. The discharge slide actuator is a two position linear actuator, preferably a pneumatic actuator. The discharge slide actuator 205 is mounted on a bracket 207 positioned such that the rod 209 of the discharge slide actuator 205 is aligned with the slide 199. The rod 209 is coupled to the slide 199 by an adjustable coupler 210. When the rod 209 of the discharge slide actuator 205 is retracted, one of the holes 201*b* in the slide 199 is aligned with the leg 197 of the Y-shaped conduit 193. When the rod 209 of the discharge slide actuator 205 is extended, the other hole 201*a* of the slide 199 is aligned with the leg 197 of the Y-shaped conduit 193. Located at opposite ends of the discharge slide actuator 205 are position sensors 211*a* and 211*b*. One of the position sensors 211*a* senses when the rod of the discharge slide actuator is retracted and the other position sensor 211*b* senses when the rod is extended. Thus, if the tube attached to the hole 203*b* in the slide 199 that is aligned with the leg 197 of the Y-shaped conduit 193 when the rod 209 of the discharge slide actuator 205 is extended runs to the fastener installation machine, sensor 211*a* forms a discharge slide accept position sensor. Since the other hole is connected to a tube that runs to a reject bin, sensor 211*b* forms a discharge slide reject position sensor. As noted above, preferably, the discharge slide actuator 205 is a pneumatic actuator whereby the position of the piston of the actuator is controlled by the application of air pressure to conduits 213*a* and 213*b* connected to either end of the housing of the discharge slide actuator 205.

FIG. 15 is a block diagram illustrating a controller 215 connected to the actuator position sensors and to the actuators of the fastener head height measuring apparatus illustrated and described above. More specifically, the controller 215 is connected to: the gauge block fastener receive position sensor 87*a*; the gauge block fastener measure position sensor 87*b*; the linear encoder calibration position sensor 87*c*; the selector plate position 1 sensor 155*a*; the selector plate position 2 sensor 155*b*; the fastener received in gauge block sensor 89; the measuring instrument extended sensor 135*b*; the measuring instrument retracted sensor 135*a*; the discharge slide accept position sensor 211*a*; and, the discharge slide reject position sensor 211*b*. The controller 215 also receives signals from the linear encoder 105 via suitable interface electronics (not shown); and, a fastener type signal from a remote source that supplies fasteners to the fastener head elevation measuring apparatus of the invention. The fastener type signal can be automatically generated by an automated supply source, or manually by an operator manually supplying fasteners to the fastener head elevation measuring apparatus. The controller 215 sends fastener receive position, linear encoder calibration position and fastener measure position control signals to the gauge block actuator 75; position 1 and position 2 control signals to the selector plate actuator 141; extend and retract control signals to the measuring instrument actuator 123; and, accept and reject control signals to discharge slide actuator 205. The control signals, in a conventional manner, control the application of pressurized air to the appropriate end of the related actuator via electrically controlled valves. The cotroller 215 also produces a head elevation signal suitable for transmission to a fastener installation machine.

In operation, after receiving a fastener type signal from the fastener supply source, the controller 215 sends a fastener receive position control signal to the gauge block actuator 75 if the split gauge block 63 is not in the fastener receive position. The controller determines whether the split gauge block 63 is in the fastener receive position by analyzing the gauge block fastener receive position sensor 87*a* and the gauge block fastener measure position sensor 87*b* signals. The controller also sends a position 1 or a position 2 control signal to the selector plate actuator 141 if the selector plate is not aligning the nozzle 61 of the fastener delivery section 39 with the position of the appropriate precisely sized hole 69*a* or 69*b*. The controller determines whether the nozzle is aligned with the appropriate hole by comparing the position of the selector plate as denoted by the selector plate position 1 sensor and the selector plate position 2 sensor signals with the fastener type signal. Thus, in essence, the controller analyzes the status of the alignment section 45 of the fastener head elevation apparatus illustrated in FIGS. 5–14 and realigns the apparatus as necessary when a fastener type signal is received. As a result, when the fastener is received, it drops from the nozzle 61 into the appropriate precisely sized hole 69*a* or 69*b*.

After the receipt of a fastener is confirmed by the fastener received in gauge block sensor 89, the controller sends a fastener measure position control signal to the gauge block actuator that causes the gauge block actuator to move the split gauge block from the fastener receive position to the fastener measure position. When the fastener measure position is reached, as denoted by the change in the status of the gauge block fastener receive and measure position sensors 87*a* and 87*b*, the controller sends an extend control signal to the measuring instrument actuator 123, which results in the linear encoder 105 being extended in the manner heretofore described. Thereafter, the controller reads the output of the linear encoder 105 and either temporarily stores this information or, if the measurement falls within an acceptable range, immediately forwards it to the fastener installation machine. If the head elevation measurement falls outside of the acceptable range, no head elevation measurement information is sent to the fastener installation machine.

After the output of the linear encoder 105 has been read, the controller determines the position of the slide 199 of the discharge section 47 by analyzing the status of the discharge slide accept and reject position sensor 211*a* and 211*b* signals. If the slide is in the appropriate position, the controller causes the pressure of the air applied to the gauge block actuator to increase. As a result, the split gauge block splits and the fastener is dropped into the manifold conduit 193. If the slide is not in the correct position, the controller applies an accept or reject control signal to the discharge slide actuator 205, which causes the slide to align the appropriate outlet tube hole with the lower leg of the Y-shaped conduit 197. Then, the pressure applied to the gauge block actuator is increased. After the fastener has been discharged, the controller causes the gauge block actuator 75 to return the split gauge block to its fastener receive position and the cycle of operation is repeated.

As will be readily appreciated from the foregoing description, the invention provides a fastener head elevation measuring apparatus that is ideally suited for use in connection with an automatic fastener installation machine. Based on the head elevation measurements made by the head elevation measuring apparatus of the invention, the fastener installation machine can be controlled to create holes with countersink regions tailored to the size of the fastener to be installed. As a result, after installation, the heads of the fasteners will be flush with the installation surface of the parts being joined.

While the invention has been described in connection with an automated fastener installation machine, it is to be understood that the invention can be used in other ways. For example, the invention can be used as an inspection device to check the head elevation quality of fasteners.

While a preferred embodiment of the invention has been illustrated and described, it will be appreciated that various changes can be made therein without departing from the spirit and scope of the invention. For example, while pneumatic actuators have been illustrated and described, if desired, electrical, mechanical or hydraulic actuators can be utilized in the various positioning mechanisms. Also, different types of head elevation measuring instruments can be utilized, if desired. Further, a split gauge block having more than two fastener receiving holes can be utilized, if desired, or, a single hole split gauge block can be utilized. Consequently, the invention can be practiced otherwise than as specifically described herein.

The embodiments of the invention is which an exclusive property or privilege is claimed are defined as follows:

1. A fastener head elevation measuring apparatus comprising:

a gauge block having an upper surface and at least one vertically oriented, precisely sized hole opening into said upper surface, said hole being sized to receive a shank of a headed fastener;

a fastener delivery mechanism for delivering head fasteners, each having a countersunk head and a shank, said fastener delivery mechanism having an outlet located above said gauge block for delivering said headed fasteners, shank down, to said vertically oriented, precisely sized hole;

a head elevation measuring instrument located above said gauge block and spaced from the outlet of said fastener delivery mechanism for measuring the elevation of the headed fastener above the upper surface of said gauge block after said fastener delivery system has delivered the headed fastener to said vertically oriented, precisely sized hole;

alignment means coupled to said gauge block for selectively aligning said vertically oriented, precisely sized hole with the outlet of said fastener delivery mechanism and said head elevation measuring instrument; and, a discharge mechanism for discharging measured fasteners from said vertically oriented, precisely sized hole in said gauge block.

2. A fastener head elevation measuring apparatus as claimed in claim 1 wherein:

said gauge block is formed of two blocks juxtaposed along a common vertical plane;

said vertically oriented, precisely sized hole is formed by semicircular indentations in each of said two blocks, said semicircular identations lying along said common vertical plane and defining the walls of said vertically oriented, precisely sized hole; and, said discharge mechanism includes means for splitting said blocks along said common plane and allowing measured fasteners to drop from said vertically oriented, precisely sized hole.

3. A fastener head elevation measuring apparatus as claimed in claim 2 wherein said gauge block includes two vertically oriented, precisely sized holes located side by side and each formed by semicircular indentations in each of said two blocks, along said common vertical plane.

4. A fastener head elevation measuring apparatus as claimed in claim 3 wherein:

apparatus includes a selector plate;

the outlet of said fastener delivery mechanism is mounted in said selector plate; and said head elevation measuring instrument means is mounted on said selector plate adjacent to said outlet of said fastener delivery mechanism.

5. A fastener head elevation measuring apparatus as claimed in claim 4 wherein said alignment means includes:

a first actuator attached to said gauge block for horizontally moving said gauge block in a direction orthogonal to said common vertical plane; and, a second actuator attached to said selector plate for moving said selector plate in a direction orthogonal to the direction of movement of said first actuator.

6. A fastener head elevation measuring apparatus as claimed in claim 5 including:

sensing means associated with said first and second actuators for sensing the position of said first and second actuators; and, a controller connected to said sensing means and to said first and second actuators for controlling the position of said first and second actuators and, thus, the position of: (i) said vertically oriented, precisely sized holes; and, (ii) said outlet of said fastener delivery mechanism and said elevation measuring instrument, with respect to one another.

7. A fastener head elevation measuring apparatus as claimed in claim 6 wherein said head elevation measuring instrument includes:

a vertically oriented probe; and, a linear actuator for vertically moving said probe into contact with the head of a headed fastener positioned in a vertically oriented, precisely sized hole aligned with said probe.

8. A fastener head elevation measuring apparatus as claimed in claim 7 wherein said discharge mechanism includes means for moving fasteners away from the walls of said vertically oriented, precisely sized holes when said blocks are split to drop measured fasteners from said vertically oriented, precisely sized holes.

9. A fastener head elevation measuring apparatus as claimed in claim 8 wherein said discharge mechanism includes directing means for directing dropped measured fasteners to one or the other of two outlet tubes.

10. A fastener head elevation measuring apparatus as claimed in claim 5 wherein said discharge mechanism includes means for moving fasteners away from the walls of said vertically oriented, precisely sized holes when said blocks are split to drop measured fasteners from said vertically oriented, precisely sized holes.

11. A fastener head elevation measuring apparatus as claimed in claim 10 wherein said discharge mechanism includes directing means for directing dropped measured fasteners to one or the other of two outlet tubes.

12. A fastener head elevation measuring apparatus as claimed in claim 3 wherein said discharge mechanism includes means for moving fasteners away from the walls of said vertically oriented, precisely sized holes when said blocks are split to drop measured fasteners from said vertically oriented, precisely sized holes.

13. A fastener head elevation measuring apparatus as claimed in claim 12 wherein said discharge mechanism includes directing means for directing dropped measured fasteners to one or the other of two outlet tubes.

14. A fastener head elevation measuring apparatus as claimed in claim 2 wherein said discharge mechanism includes means for moving fasteners away from the walls of said vertically oriented, precisely sized hole when said blocks are split to drop measured fasteners from said vertically oriented, precisely sized hole.

15. A fastener head elevation measuring apparatus as claimed in claim 14 wherein said discharge mechanism includes directing means for directing dropped measured fasteners to one or the other of two outlet tubes.

* * * * *

UNITED STATES PATENT AND TRADEMARK OFFICE

CERTIFICATE OF CORRECTION

PATENT NO. : 4,877,138

DATED : October 31, 1989

INVENTOR(S) : Mohammad I. Motiwala

It is certified that error appears in the above-identified patent and that said Letters Patent is hereby corrected as shown below:

| | |
|---|---|
| Column 9, line 51: | "instrument 123" should be --instrument actuator 123-- |
| Column 11, line 24: | "o" should be --of-- |
| Column 12, line 26: | "203a runs" should be --203a and runs-- |
| Column 13, line 25: | "cotroller" should be --controller-- |

Signed and Sealed this

Twenty-fifth Day of December, 1990

*Attest:*

HARRY F. MANBECK, JR.

*Attesting Officer*

*Commissioner of Patents and Trademarks*